United States Patent [19]

Harrison

[11] Patent Number: 4,725,717

[45] Date of Patent: Feb. 16, 1988

[54] IMPACT-RESISTANT ELECTRICAL HEATING PAD WITH ANTISTATIC UPPER AND LOWER SURFACES

[75] Inventor: John M. Harrison, Chattanooga, Tenn.

[73] Assignee: Collins & Aikman Corporation, New York, N.Y.

[21] Appl. No.: 13,677

[22] Filed: Feb. 12, 1987

Related U.S. Application Data

[63] Continuation-in-part of Ser. No. 791,787, Oct. 28, 1985, Pat. No. 4,661,689.

[51] Int. Cl.[4] ..... H05B 3/34

[52] U.S. Cl. ..... 219/528; 219/549

[58] Field of Search ..... 219/213, 345, 528, 549; 338/212, 214; 361/216, 220, 212

[56] References Cited

U.S. PATENT DOCUMENTS

| | | | |
|---|---|---|---|
| 2,302,003 | 11/1942 | Cadwell et al. | 361/212 X |
| 2,323,461 | 7/1943 | Donelson | 361/216 |
| 2,457,299 | 12/1948 | Biemesderfer, Jr. | 361/216 X |
| 2,851,639 | 9/1958 | Ford et al. | 361/216 |
| 3,121,825 | 2/1964 | Abegg et al. | 361/216 X |
| 3,371,247 | 2/1968 | Mallenger | 361/212 |
| 3,454,746 | 7/1969 | Dubois | 219/213 X |
| 4,247,756 | 1/1981 | Cucinotta et al. | 219/549 |
| 4,415,946 | 11/1983 | Pitts | 361/212 |
| 4,472,471 | 9/1984 | Klein et al. | 361/212 X |
| 4,485,297 | 11/1984 | Grise et al. | 219/528 |
| 4,491,894 | 1/1985 | Pitts | 361/212 |
| 4,661,689 | 4/1987 | Harrison | 219/528 |

FOREIGN PATENT DOCUMENTS 798043 7/1958 United Kingdom .

*Primary Examiner*—E. A. Goldberg
*Assistant Examiner*—M. M. Lateef
*Attorney, Agent, or Firm*—Bell, Seltzer, Park & Gibson

[57] ABSTRACT

An impact-resistant electrical heating pad is characterized in that both upper and lower surfaces are antistatic. A preferred embodiment of the pad comprises a scrim fabric, a resistance heating wire carried by the scrim fabric, and sheets of high impact plastic material connected to opposing sides of the scrim fabric to form upper and lower plastic sheets. These impact-resistant plastic sheets have electrically conductive particles distributed throughout, so that the sheets themselves are electrically conductive. An electrical conductor is connected to the electrical resistance wire for energizing the same, and is also connected to the plastic sheets for eliminating static electricity from the pad. A ground fault detection circuit is connected to the electrical conductor to interrupt the power supply to the resistance heating wire if a short occurs.

14 Claims, 11 Drawing Figures

IMPACT-RESISTANT ELECTRICAL HEATING PAD WITH ANTISTATIC UPPER AND LOWER SURFACES

RELATED APPLICATIONS

This application is a continuation-in-part of pending application Ser. No. 791,787, filed Oct. 28, 1985, now U.S. Pat. No. 4,661,689 issued 4/28/87.

FIELD OF THE INVENTION

This invention relates to an impact-resistant electrical heating pad and, more particularly, to an electrical heating pad having antistatic upper and lower surfaces.

BACKGROUND OF THE INVENTION

As the cost of energy has continued to rise steadily in significant proportions in recent years, the need for economic and efficient heating means has become great. This need has become particularly acute in commercial and industrial settings because of the specific problems encountered in those areas. In the commercial setting because of the frequent presence of computer related business equipment, it is often desirable to maintain the entire business or office environment at a cooler temperature than may be comfortable for most personnal. It is also desirable to avoid heating the entire environment in order to minimize energy comsumption and expense. However, in office settings such efforst at energy savings have typically been counter-productive when sedentary personnel have required electrical space heaters for personal comfort. Such heaters while serving to supply heat to specific areas, consume substantial quantities of energy and present such hazards as overheating, fire and electrical shock.

Further problems are presented in industrial environments such as factories, mills and shops wherein the entire area of a facility to be heated may be so huge that maintaining the entire area at a temperature comfortable to personnel is virtually impossible and, in any event, economically unfeasible. Supplemental heat sources of various types have been used in industrial settings, such as electrical space and overhead radiation heaters, catalytic space heaters, forced air space heaters, and even open flame heaters. In the main, such heaters have proven to be unduly expensive to operate and maintain, inadequate at maintaining a comfortable temperature, and extremely hazardous in certain types of industrial workplace settings.

Another means of heating localized areas which has been proposed has been the use of floor mats or pads containing an electrical heat source to provide an indirect type of heat emanating from floor level for a particular area. Such pads have not been fully satisfactory either, however. Firstly, these pads have typically utilized a heating circuit including a length of resistance wire which, when energized with electrical current, generates heat. While this is a relatively simple type of heat source, it is one subject to being unreliable and unsafe. Fracture of the resistance wire can occur anywhere in the pad as a result of simple wear, or as the result of any number of causes such as from the spiked heel of a lady's shoe or from a falling tool. Such a fracture can serve to render the entire heating capability of the pad inoperative, and such a fracture can also result in deadly electrical shock or a short which can cause a fire or explosion. For these reasons, these pads have so far not been popular in commercial or industrial surroundings where they would likely be subjected to substantial foot traffic or where moisture or hostile chemicals could be expected to be encountered.

Although improvements have been made in heating pads such as by making the heat source less vulnerable to rupture and less a shock hazard, so far as applicant is aware prior to this invention, there still has been no electrical floor heating pad available for commercial or industrial uses that could satisfy Underwriters' Laboratories safety standards. Also, so far as applicant is aware prior to this invention, there has been no electrical heating pad available which eliminates static electricity build-up on the surface of same. In most offices and plants, the presence of static electricity can present substantial problems to personnel and equipment.

SUMMARY OF THE INVENTION

It is accordingly an object of the present invention to provide an electrical heating pad of the type adapted to be placed on a floor and walked upon. The pad comprises an electrical resistance means serving as a heater for supplying heat to the pad. Sheets of solid high impact plastic material are positioned on opposing sides of said electrical resistance means to form upper and lower surfaces with the electrical resistance means encapsulated therebetween. The sheets of plastic material have electrically conductive material present on the outer surfaces thereof. An elongate electrical conductor means is electrically connected to the electrical resistance means and is also electrically connected to the electrically conductive outer surfaces of the plastic material. This elongate electrical conductor means provides a source of electrical power for the electrical resistance means, and also provides a means for conducting away any static electricity present in the outer surfaces of the pad.

A further object of the present invention is to provide an electrical heating pad of the type adapted to be placed on a floor and walked upon, which pad includes a ground fault detection means. Such a pad comprises an electrical resistance means serving as a heater for supplying heat to the pad. Sheets of solid high impact plastic material are positioned on and connected to opposing sides of the electrical resistance means to form upper and lower surfaces with the electrical resistance means encapsulated therebetween. The sheets of plastic material have electrically conductive material present on the outer surfaces thereof. An elongate electrical conductor means is electrically connected to the electrical resistance means, and is also electrically connected to the electrically conductive outer surfaces of the plastic material. This elongate electrical conductor means provides a source of electrical power for the electrical resistance means, and also provides a means for conducting away any static electricity present in the outer surfaces of said pad. Ground fault detection means are electrically connected to the elongate electrical conductor means for interrupting the supply of power to the electrical resistance means when an electrical contact is made between the electrical resistance means and the upper or lower surface.

A more specific object of the present invention is to provide an electrical heating pad of the type adapted to be placed on a floor and walked upon, which pad includes a ground fault detection means, and which pad is characterized in that it is constructed so that either surface may be uppermost without impairing the operability of the pad. The pad comprises a scrim fabric, a resistance heating wire carried by and connected to the scrim fabric, and sheets of solid high impact plastic material positioned on and connected to opposing sides of the scrim fabric to form upper and lower plastic sheets with the scrim fabric and the resistance heating wire encapsulated therebetween. The sheets of plastic material have nonplanar outer surfaces, so as to impart antislip properties thereto. Electrically conductive particles are distributed throughout said plastic sheets, including the outer surfaces thereof, so that the upper and lower plastic sheets are themselves electrically conductive. An elongate electrical conductor means is electrically connected to the resistance heating wire, and is also electrically connected to the electrically conductive outer surfaces of the plastic sheets. This elongate electrical conductor means provides a source of electrical power for the resistance heating wire, and also provides means for conducting away any static electricity present in the outer surfaces of the pad. Ground fault detection means are electrically connected to the elongate electrical conductor means for interrupting the supply of power to the resistance heating wire when an electrical contact is made between the resistance heating wire and the electrically conductive upper or lower plastic sheet.

BRIEF DESCRIPTION OF THE DRAWINGS

These and other objects and advantages of the present invention will be made apparent from the following description and drawings, in which.

DETAILED DESCRIPTION OF THE ILLUSTRATED EMBODIMENTS

While the present invention will be described more fully hereinafter with reference to the accompanying drawings, in which particular forms of carrying out the present invention are shown, it is to be understood at the outset that persons of skill in the appropriate arts may modify the forms of the invention here described while still achieving the favorable results of this invention. Accordingly, the description which follows is to be understood as being a broad, teaching disclosure directed to persons of skill in the appropriate arts, and not as limiting upon the present invention.

Figure 1:
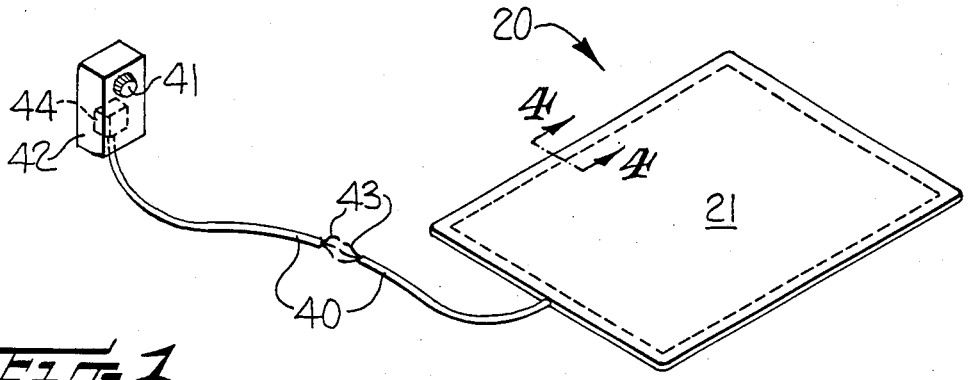
FIG. 1 is an environmental view generally illustrating the heating pad of the invention.
Figure 2:
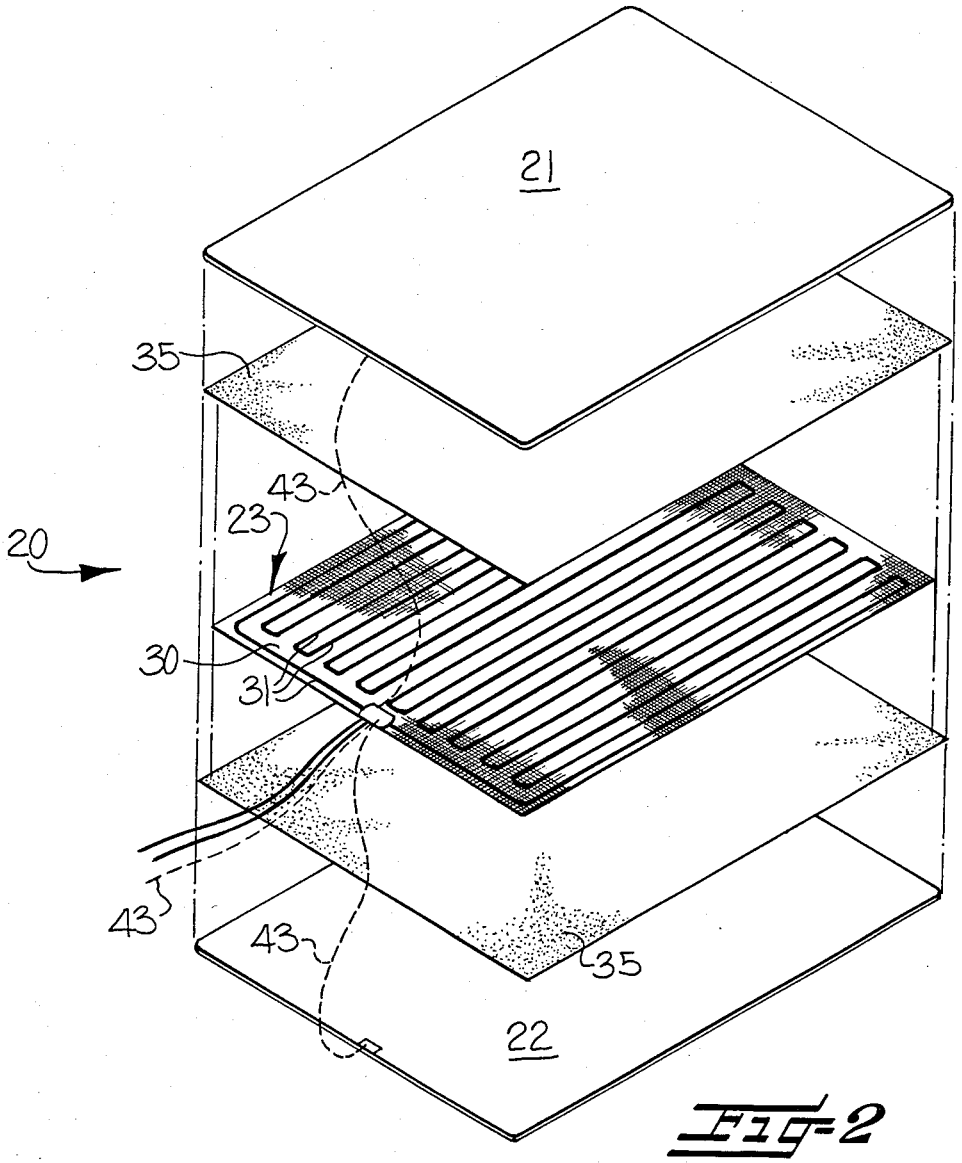
FIG. 2 is a perspective exploded view of the pad of the invention illustrating its component construction.
Figure 3:
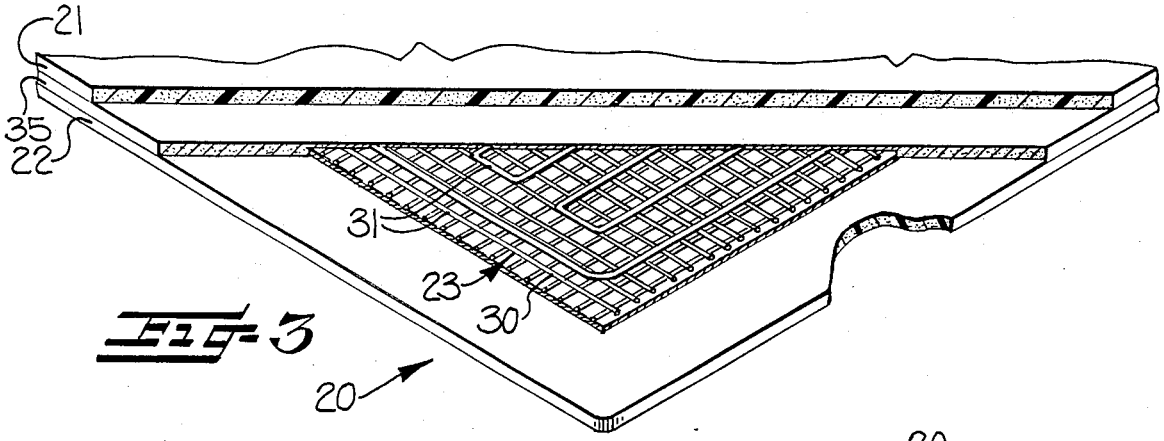
FIG. 3 is a partial perspective view of a heating pad of the present invention with portions broken away to show its component parts.
Figure 4:
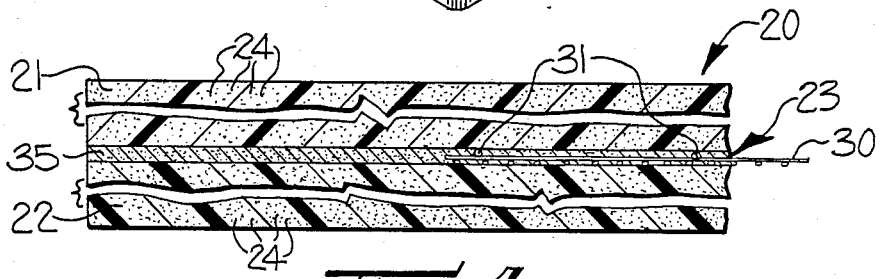
FIG. 4 is a vertical cross-sectional view of the pad of the present invention taken along lines 4—4 of FIG. 1.

Referring now more specifically to the drawings, FIG. 1 illustrates an embodiment of the invention as it would appear in a typical commercial setting such as a business office, and FIGS. 2, 3 and 4 illustrate its component construction. As illustrated, the heating pad 20 of the invention is adapted to be placed on a floor and walked upon in the area being heated. Heating pad 20 is generally characterized in that it may not readily be damaged or mechanically penetrated from either above or below, as by the dropping of sharp instruments onto the pad. Heating pad 20 comprises a top layer 21 and a bottom layer 22, and an electrical resistance means 23 encapsulated therebetween serving as a heater for supplying heat to the pad 20.

The top layer 22 and the bottom layer 23 are both comprised of a sheet of high impact plastic material preferably having textured, nonplanar outer surfaces serving to impart antislip properties thereto. These top and bottom layers may specifically be formed of high impact ABS or other suitable material of about ⅛ inch in thickness or more, which can adequately protect the encapsulated electrical resistance means from penetration, including penetration by either falling objects, or sharp objects positioned beneath the pad when a downward force is applied to the top surface of the pad. When additional protection is desired, as in certain industrial applications, thicker layers may be used.

Electrically conductive or semi-conductive particles 24 such as carbonaceous particles are desirably compounded into the top and bottom layers and are present in the outer surfaces thereof, for imparting anti-static properties to the outer surfaces. It is important to include in the pad such a means for eliminating the build-up of static electricity, considering the environments for which pad 20 is intended for use. In addition to being annoying to personnel encountering minor shocks, the presence of static electricity presents particular problems to operations in office and industrial environments. For example, in offices containing computers and various types of data processing equipment, the presence of static electricity and stray currents can introduce undetectable errors in stored information, or can even disable such equipment. In industrial settings such as factories or laboratories, the presence of static electricity can be extremely detrimental to manufacturing operations, and can even lead to a devastating explosion if inflammable substances are present.

Figure 5:
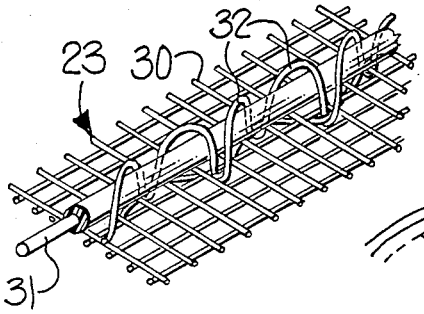
FIG. 5 is a perspective view showing details of the construction of the electrical resistance means shown in FIG. 4.

As best shown in FIGS. 2, 3 and 5, the electrical resistance means 23 preferably comprises a scrim fabric 30 formed of woven textile material, and a resistance heating wire 31 positioned on one surface of the scrim fabric in a predetermined generally sinuous pattern. The resistance heating wire is secured to the scrim fabric by means of a thread 32 looping through the scrim fabric and over the wire as shown in FIG. 5, though other suitable securing means, such as an adhesive, could also be used.

The scrim fabric 30 is of a smaller overall size than the top and bottom layers 21, 22, with the peripheral edge portions of the scrim fabric being positioned inwardly from the peripheral edge portions of the top and bottom layers. This permits the electrical resistance means to be encapsulated between the top and bottom layers. The top and bottom layers are preferably bonded together completely where they contact one another with an adhesive 35, most desirably an electrically conductive adhesive (such as an acrylic adhesive having electrically conductive particles distributed therein), and likewise bonded to the scrim fabric. The choice of adhesive is not critical, as long as it does not result in a product which will delaminate at continuous operation in excess of 100° F.

An elongate electrical conductor line 40 is electrically connected to the resistance heating wire for supplying power thereto. This conductor has inner end portions thereof desirably embedded in and bonded to the body of the heating pad, with the conductor extending outwardly therefrom for connection to a suitable source of electrical power. As shown in FIG. 1, a temperature control means such as an adjustable rheostat 41 is preferably included and electrically connected to the outer end of the electrical conductor for selectively controlling the temperature of the pad.

An electrical conductor plug (not shown) is also electrically connected to the outer end of electrical conductor and desirably, along with temperature control means 41, contained in a common housing 42 for compactness and protection of the internal components. Housing 42 may be formed of plastic, rubber or some other suitable durable electrical insulating material. Conductor line 40 also desirably includes an electrically conductive grounding line 43 electrically connected to either (or both) of the electrically conductive plastic material of the upper and lower surfaces of the pad, and serves as means for conducting away static electricity present in the pad. Grounding line 43 includes electrical resistance means desirably located within housing 42 to dissipate and eliminate the static charge conducted therethrough.

For added safety against electrical shock hazard there may be provided a ground fault circuit interrupter relay 44 connected to the outer end of said electrical conductor to interrupt the electrical current supply if a shorting condition occurs, such as an electrical contact between the resistance heating wire and either the upper or lower electrically conductive plastic sheet. This relay likewise may be desirably contained in and protected by housing 42.

Figure 6:
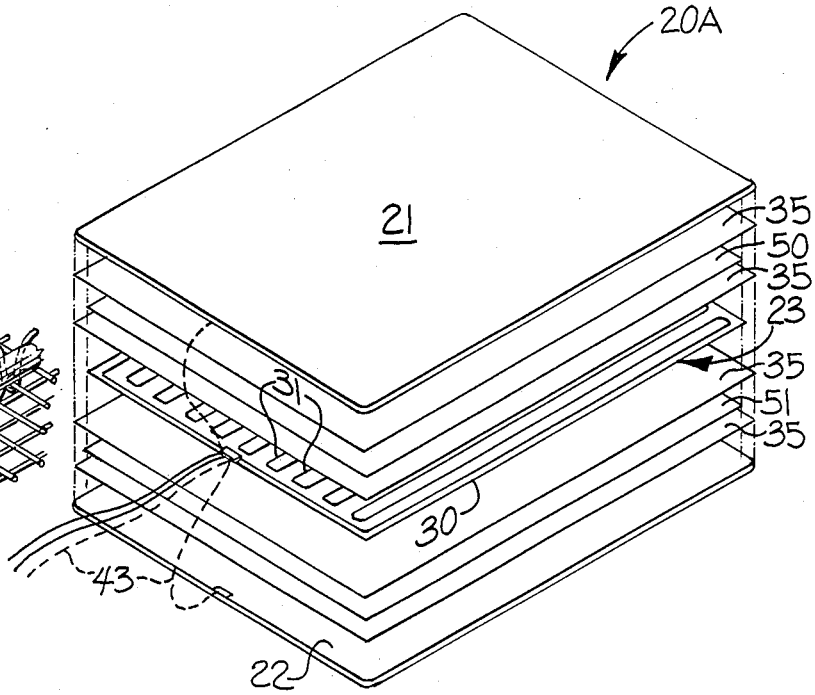
FIG. 6 is a perspective exploded view of a second embodiment of the present invention, showing the inclusion of metallic sheets on opposite sides of the resistance heater.
Figure 7:
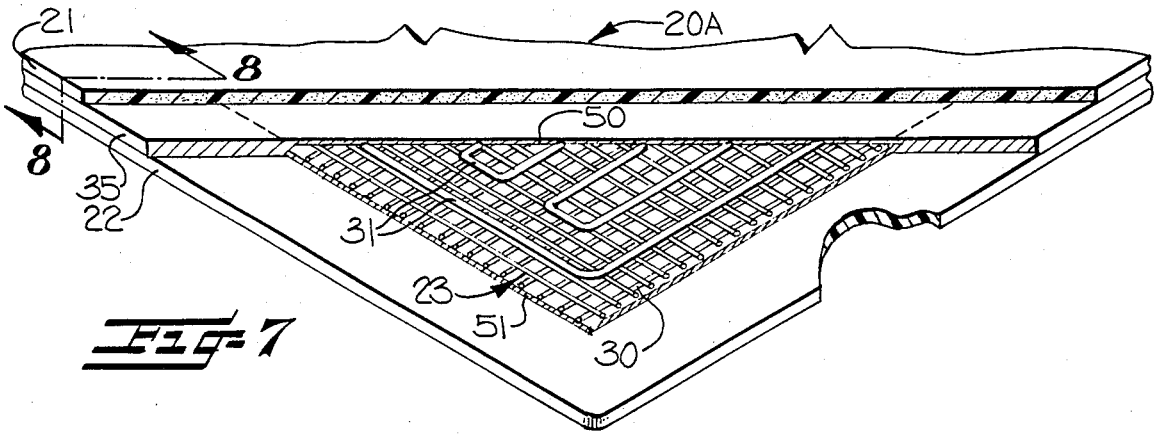
FIG. 7 is a partial perspective view of the second embodiment of the heating pad of the present invention shown in FIG. 6 with portions broken away to show its component parts.
Figure 8:
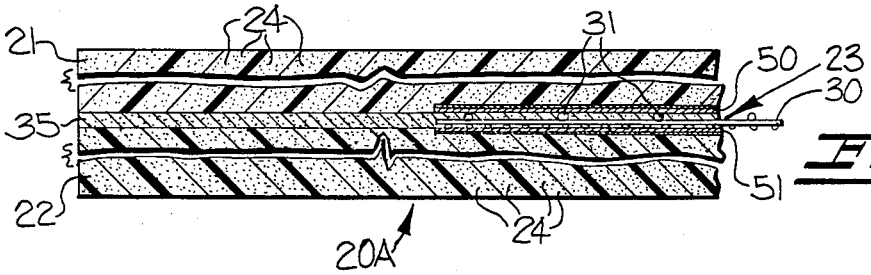
FIG. 8 is a vertical cross-sectional view of the second embodiment of the heating pad of the present invention shown in FIG. 7, taken along lines 8—8 of FIG. 7.

A second embodiment 20A of the present invention is shown in FIGS. 6, 7 and 8. In this embodiment, metallic sheets 50, 51 are positioned between the electrical resistance means 23 and the upper and lower plastic sheets 21, 22. These sheets 50, 51 are electrically connected to the elongate electrical conductor means (either by means of a direct connection or through a conductive adhesive) for connection to ground, and serve as an additional shield for the electrical resistance means 23. Such sheets can be used in addition to, or instead of, the inclusion of conductive particles in the plastic sheets, though if used as a substitute the pad would not have as satisfactory antistatic properties as a pad including conductive particles in the plastic sheets.

Figure 9:
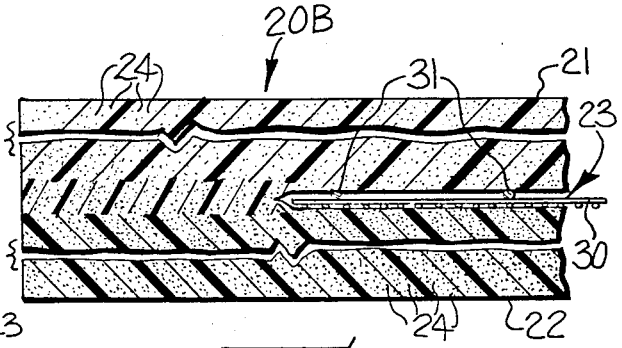
FIG. 9 is a vertical cross-sectional view of a heating pad of the present invention, showing a third embodiment of the invention having a welded edge construction.

FIG. 9 illustrates an alternative means of assembling a pad 20B of the present invention. In this third embodiment, the upper and lower sheets 21, 22 are formed of thermoplastic material, and the edge portions of the sheets ar thermally fused to one another so that the electrical resistance means 23 is encapsulated therebetween. When the upper and lower sheets include electrically conductive particles, as explained above, this thermal fusion serves to electrically connect the upper and lower sheets to one another.

Figure 10:
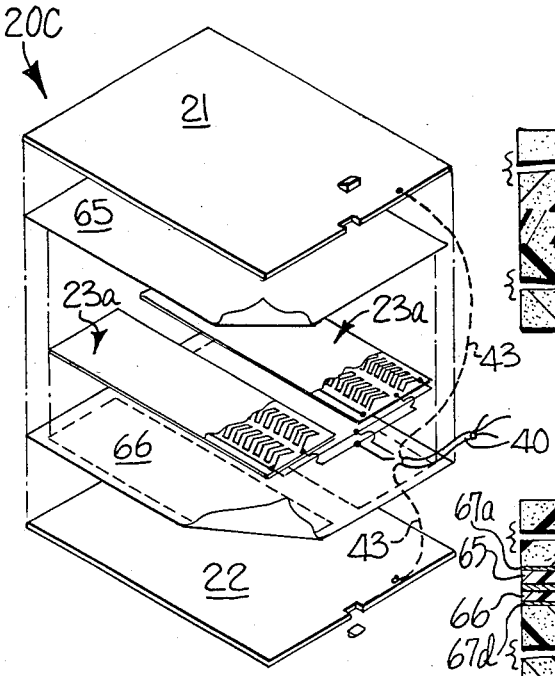
FIG. 10 is a perspective exploded view of a fourth embodiment of the present invention.
Figure 11:
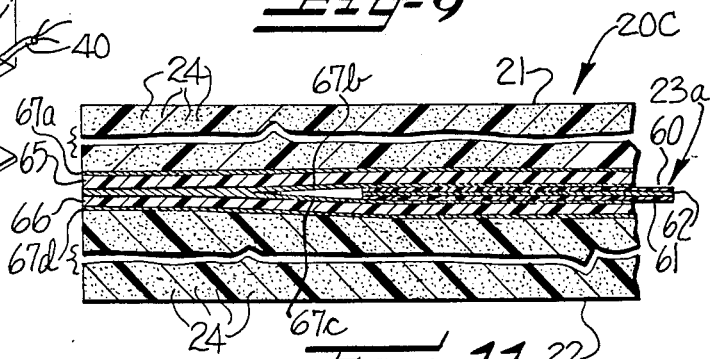
FIG. 11 is a vertical cross-sectional view of the fourth embodiment of the present invention shown in FIG. 10.

A fourth embodiment 20C of the present invention is illustrated in FIGS. 10 and 11. As shown in these figures, the electrical resistance means **23*a* comprises a relatively thin plastic envelope formed by opposing thin sheets 60, 61 of plastic, one of said opposing plastic sheets having an electrical resistance circuit 62 printed on the inside face thereof, the other opposing plastic sheet being sealed to the first sheet so as to form an encapsulated and completely sealed electrical resistance heater therebetween. One heater of this type is shown and illustrated in U.S. Pat. No. 4,485,297, assigned to Flexwatt Corporation. Alternatively (and not shown), a continuous layer of electrical resistance material could be included between these sheets. Each of these opposing plastic sheets 60, 61** is on the order of only one mil in thickness or less, so that the composite heater is very thin, desirably less than 1/64 inch. This allows the heating pad to be relatively thin, less than about ½ inch, so as not to create an impediment underfoot.

In pad 20C as illustrated in FIG. 10, a plurality of spaced apart electrical resistance means **23*a* are utilized and positioned between the top and bottom layers 21, 22**, and electrically connected together in parallel relation. Utilizing such an arrangement, acceptable heating may be maintained even if one unit should fail. Also, such parallel circuiting prevents the opening of one heater circuit from causing all heaters to be inoperative. If desired, control of multiple heaters may be stepped (one, two or three heaters on at a time) to control the amount of heat being generated.

As shown in FIG. 10 (see also FIG. 11) each electrical resistance means **23*a* is desirably completely surrounded and sealed at its periphery by the top and bottom layers 21, 22, to provide further protection from moisture and the environs for heaters which are themselves sealed units. Desirably, top and bottom layers, 21 and 22, are bonded together completely where they contact one another and likewise where they contact electrical resistance means 23*a* to perfect this exterior seal around the heaters. Such sealing and bonding in this embodiment is accomplished by utilizing a release paper carried adhesive. This form of adhesive comprises a relatively thin sheet 65, 66 (less than 1/32" thick) of adhesive material with adhesive surfaces 67*a*, 67*b*, 67*c*, 67*d* on opposite sides thereof with a layer of release paper on each side for handling. Once the sheet is positioned the layers of release paper are removed, leaving the adhesive surfaces exposed for use. Here, desirably, one adhesive sheet is positioned between said encapsulated electrical resistance means and said top layer 21, and another adhesive sheet is positioned on the opposite side of said encapsulated resistance means between said bottom layer 22**, whereby said encapsulated electrical resistance means is essentially further encapsulated against moisture. Use of such adhesive means guarantees uniform and complete adhesive coverage without gaps.

The heating pad of the invention is thus fully portable and serves as a safe means of providing primary or supplemental heat to a particular area while also serving to protect the carpet or floor underneath and eliminating the build-up of undesired static electricity. Thus while the primary and central heating system of an office or factory might maintain a continuing temperature of 50° F. to 60° F. throughout, pads of the invention can be used in those particular areas being occupied by personnel to provide supplemental heat as needed. Or, if desired, multiple pads of the invention could be used to maintain a constant background temperature level and conventional space heaters could be used in local areas intermittently to produce additional heat when and where it is needed.

Furthermore, the structure and features of the invention provide a heater which is uniquely safe. For example, the current conducting portion of the heater is protected and sealed to prevent shock hazard even if the surrounding area is flooded by liquid. Also, containing the temperature control box and electrical supply in a common housing 42 apart from the pad 20 protects these relatively vulnerable components from possible damage.

Testing

The desired embodiment is intended to perform satisfactorily when subjected to a variety of operational tests. In such tests a sample is laid on a floor of a 90° alcove consisting of two vertical walls of ⅜" black painted plywood supported by vertical studs (nominal 2×4) on 16 inch centers. The floor shall be ¾" plywood. The heater shall be located as close to the sides of the wall angle as its construction shall permit. All tests discussed below are conducted in this test environment construction.

Continuous Operation Tests (1) Power Input: The power input shall not be more than 105% nor less than 90% of the given rating while connected to a supply circuit of rated voltage.

(2) Normal Temperature Tests: Maximum allowable temperature for materials and support surfaces is 90° C. based on a 25° C. ambient. Temperatures are to be measured by No. 30 AWG Type J thermocouples and a potentiometer-type instrument. The heater is to be operated continuously until constant temperatures have been reached. The test voltage is to be highest marked voltage or, if the measured wattage is not equal or more than the marked wattage rating, the test voltage is to be increased until the measured wattage input equals the marked wattage rating.

(3) Dielectric Withstand Test: After the sample has been operated for a period of time so as to be in a heated condition, an AC potential is applied between current-carrying parts and dead-metal parts. For this test, a dead-metal part is a single sheet of aluminum foil placed in close contact with the exposed top surface of the sample. Starting at zero, the potential is gradually increased to 1000 V and maintained at this value for a period of one minute without insulation breakdown.

(a) Repeated with foil in close contact with both top and bottom surfaces.

(b) Repeated using antistatic surface as deadmetal part.

(4) Leakage Current Test: The sample is placed on an insulating surface and a 1500 ohm resistor, shunted by a 0.15 μf capacitor connected between dead-metal parts, simulated by a single sheet of aluminum foil placed in close contact with the top surface of the sample, and the neutral conductor with readings recorded. A suitable meter is used to measure the voltage drop across the resistor under the following conditions:

(a) Unenergized line conductor open, neutral conductor closed.

(b) Same as (a) with attachment plug reversed.

(c) Sample operated in the intended manner with periodic readings taken as the leakage current reaches equilibrium. Each reading is taken with the plug inserted in both possible positions and the maximum value recorded.

Abnormal Operation Tests (1) Static Load Test: On a sample, a simulated four legged stool with flat bottom legs, each approximately ⅞" diameter placed with all four legs directly over one or more of the heated areas of the element, is to be loaded with 600 pounds of weight. After 15 days the following tests are conducted:

(a) Sample is energized to determine if it will operate as intended.

(b) Dielectric withstand test described above.

(c) Inspection of sample to determine the effect of the prolonged static load.

2.Dynamic Load Test: On a sample, a metal caster, having diameter of approximately two inches and a width of approximately one inch arranged to apply a load of 150 pounds on the covering, is to be driven back and forth over 12 inches of travel above one section of heated area. After 6000 cycles the following tests are conducted:

(a) Sample energized to see if it will function as intended.

(b) Dielectric withstand test described above.

(c) Visual inspection of the sample to determine any adverse effects.

(3) Immersion Tests: A sample is immersed in tap water for a period of four hours after which the following tests are conducted:

(a) Energized operation for two hours without hot spots and/or adverse conditions.

(b) Dielectric withstand test described above.

Following the test after immersion in the tap water the sample is immersed in a saline solution of eight grams of table salt per liter of tap water for a period of four hours after which the following tests are conducted:

(a) Energized operation for two hours without hot spots and/or adverse conditions.

(b) Dielectric withstand test described above.

(4) Abuse Test: A flat iron weighing approximately four pounds is dropped on an energized sample installation 10 times with the point down from a height of three feet in such a manner as to land in the same six inch square of the sample. Then the installation is deenergized and subjected to a dielectric withstand test.

(5) Over-voltage Test: On a sample, a one inch thick hair felt pad is placed over the entire surface with any seams in the hair felt pad overlapping by two inches. The system is energized and operated at 125% of the watt density per square foot of heated areas as determined from the continuous operation test, for seven hours (equivalent to 112.5% over-voltage). Failure mode occurs if there is ignition, emission of smoke, or excessive deterioration.

(6) Puncture Test: For industrial application the heater may be required to meet a puncture test wherein the top surface material of a sample is penetrated with metal carpet tacks of sufficient lengths to pierce through the surface into the heating element so that there is continuity between heating element and the metal tacks. This is repeated 25 times after which the tacks are removed and the following tests are conducted:

(a) Sample is energized for two hours to see if it will operate as intended.

(b) Dielectric withstand test.

(c) Visually inspect components of the system to determine any adverse conditions.

In the drawings and specification, there has been disclosed typical preferred embodiments of the invention and although specific terms ar employed, they are used in a generic and descriptive sense only and not for purposes of limitation.

That which is claimed is:

1. An electrical heating pad of the type adapted to be placed on a floor and walked upon, said pad comprising electrical resistance means serving as a heater for supplying heat to the pad, sheets of solid high impact plastic material positioned on and connected to opposing sides of said electrical resistance means to form upper and lower surfaces with said electrical resistance means encapsulated therebetween, said sheets of plastic material having electrically conductive material present on the outer surfaces thereof, elongate electrical conductor means electrically connected to said electrical resistance means and also electrically connected to the electrically conductive outer surfaces of the plastic material for providing a source of electrical power for said electrical resistance means and for also providing means for conducting away any static electricity present in the outer surfaces of said pad, and ground fault detection means electrically connected to said elongate electrical conductor means for interrupting the supply of power to said electrical resistance means when an electrical contact is made between said electrical resistance means and said upper or lower surface.

2. An electrical heating pad as claimed in claim 1, wherein said electrically conductive material comprises electrically conductive particles distributed throughout said plastic sheets including said outer surfaces thereof, and wherein an electrically conductive adhesive connects said plastic sheets to said electrical resistance means and to one another so that said sheets are electrically connected to one another.

3. An electrical heating pad as claimed in claim 1, wherein said electrically conductive material comprises electrically conductive particles distributed throughout said plastic sheets including said outer surfaces thereof, and wherein said sheets are formed of thermoplastic material and have edge portions thermally fused to one another so that said sheets are electrically connected to one another.

4. An electrical heating pad as claimed in claim 1, wherein said resistance heating means are of a smaller overall size than said plastic sheets, and wherein peripheral edge portions of said resistance heating means are positioned inwardly from the peripheral edge portions of the plastic sheets.

5. An electrical heating pad as claimed in claim 1, wherein said electrical resistance means comprises a scrim fabric and a resistance heating wire carried by and connected to said scrim fabric.

6. An electrical heating pad as claimed in claim 1, wherein said electrical resistance means comprises a scrim fabric formed of woven textile material, a resistance heating wire positioned on one surface of the scrim fabric in a predetermined generally sinuous pattern, and means securing said resistance heating wire to said scrim fabric.

7. An electrical heating pad of the type adapted to be placed on a floor and walked upon characterized in that the pad is constructed so that either surface may be uppermost without impairing the operability of the pad, said pad comprising electrical resistance means serving as a heater for supplying heat to the pad, sheets of solid high impact plastic material positioned on opposing sides of said electrical resistance means to form upper and lower surfaces with said electrical resistance means encapsulated therebetween, said sheets of plastic material having electrically conductive material present on the outer surfaces thereof, and elongate electrical conductor means electrically connected to said electrical resistance means and also electrically connected to the electrically conductive outer surfaces of the plastic material for providing a source of electrical power for said electrical resistance means and for also providing means for conducting away any static electricity present in the outer surfaces of said pad.

8. An electrical heating pad as claimed in claim 7, wherein said electrically conductive material comprises electrically conductive particles distributed throughout said plastic sheets including said outer surfaces thereof, and wherein an electrically conductive adhesive connects said plastic sheets to said electrical resistance means and to one another so that said sheets are electrically connected to one another.

9. An electrical heating pad as claimed in claim 7, wherein said electrically conductive material comprises electrically conductive particles distributed throughout said plastic sheets including said outer surfaces thereof, and wherein said plastic sheets are formed of thermoplastic material and have edge portions thermally fused to one another so that said sheets are electrically connected to one another.

10. An electrical heating pad as claimed in claim 7, wherein said resistance heating means are of a smaller overall size than said plastic sheets, and wherein peripheral edge portions of said resistance heating means are positioned inwardly from the periphery of the plastic sheets.

11. An electrical heating pad as claimed in claim 7, wherein said electrical resistance means comprises a scrim fabric and a resistance heating wire carried by and connected to said scrim fabric.

12. An electrical heating pad as claimed in claim 7, wherein said electrical resistance means comprises a scrim fabric formed of woven textile material, a resistance heating wire positioned on one surface of the scrim fabric in a predetermined generally sinuous pattern, and means securing said resistance heating wire to said scrim fabric.

13. An electrical heating pad of the type adapted to be placed on a floor and walked upon characterized in that the pad is constructed so that either surface may be uppermost without impairing the operability of said pad, said pad comprising a scrim fabric, a resistance heating wire carried by and connected to the scrim fabric, sheets of solid high impact plastic material positioned on and connected to opposing sides of said scrim fabric to form upper and lower plastic sheets with said scrim fabric and said resistance heating wire encapsulated therebetween, said sheets of plastic material having nonplanar outer surfaces so as to impart antislip properties thereto, electrically conductive particles distributed throughout said plastic sheets including said outer surfaces thereof so that said upper and lower plastic sheets are electrically conductive, elongate electrical conductor means electrically connected to said resistance heating wire and also electrically connected to the electrically conductive outer surfaces of said plastic sheets for providing a source of electrical power for said resistance heating wire and for also providing means for conducting away any static electricity present in the outer surfaces of said pad, and ground fault detection means electrically connected to said elongate electrical conductor means for interrupting the supply of power to said resistance heating wire when an electrical contact is made between said resistance heating wire and said electrically conductive upper or lower plastic sheet.

14. An electrical heating pad as claimed in claim 13, wherein said scrim fabric is of a smaller overall size than said plastic sheets and peripheral edge portions of said scrim fabric are positioned inwardly from the periphery of the plastic sheets, and wherein an electrically conductive adhesive connects said plastic sheets to said scrim fabric and to one another so that said sheets are electrically connected to one another.

* * * * *